US005618101A

United States Patent [19]

Yeh

[11] Patent Number: 5,618,101

[45] Date of Patent: Apr. 8, 1997

[54] COMBINATION FLOOR LAMP AND COMPACT-DISC STORAGE RACK

[76] Inventor: John Yeh, 660 S. Aberdeen, Anaheim Hills, Calif. 92807

[21] Appl. No.: 312,033

[22] Filed: Sep. 26, 1994

Related U.S. Application Data

[63] Continuation-in-part of Ser. No. 82,489, Jun. 28, 1993, which is a continuation-in-part of Ser. No. 1,257, Nov. 9, 1992, Pat. No. Des. 344,360.

[51] Int. Cl.[6] ..... F21S 1/02

[52] U.S. Cl. ..... 362/253; 362/410

[58] Field of Search ..... 362/132, 154, 362/253, 410, 414, 431; 312/9.9, 223.5; 211/40, 41; D26/93, 110

[56] References Cited

U.S. PATENT DOCUMENTS

| | | | |
|---|---|---|---|
| D. 70,896 | 8/1926 | Pilow | D26/93 |
| D. 146,867 | 6/1947 | Miller | D26/110 |
| D. 212,641 | 11/1968 | Mork et al. | D26/93 |
| 4,079,241 | 3/1978 | Marchio | 362/253 |
| 4,939,625 | 7/1990 | Olson | 362/253 |
| 5,195,642 | 3/1993 | Dardashti | 211/41 |

*Primary Examiner*—Y My Quach

*Attorney, Agent, or Firm*—Francis X. LoJacono

[57] ABSTRACT

A floor lamp structure wherein the upright lamppost of the floor lamp has an upper section and a lower section, whereby there is defined an elongated housing having a storage rack formed therein which and formed with a multiplicity of storage slots that are defined by outwardly extending, spaced-apart, rib members that provide a means for removably storing compact discs along the length of the lamppost.

9 Claims, 3 Drawing Sheets

8
5

48
10a
50
60
42
45
47
44
68
54
56
46
70
65
62
14
15

COMBINATION FLOOR LAMP AND COMPACT-DISC STORAGE RACK

The present application is a CONTINUATION-IN-PART of pending application Ser. No. 08/082,489 filed on Jun. 28, 1993, which is a CONTINUATION-IN-PART of application Ser. No. 29/001,257 filed on Nov. 9, 1992 by the present inventor, and has issued as Design Patent No. D344360 on Feb. 15, 1994.

BACKGROUND OF THE INVENTION

The present invention relates generally to a floor lamp and more particularly to a floor lamp having an upright post that defines a compact-disc (CD) storage rack having two frame sections that are adapted to be removably connected to each other along its length so as to support a lamp fixture.

Compact discs are commonly stored in specially designed boxes, drawers, carrying cases and compartmentalized shelf structures but until now the storage rack for compact discs has not been made as a direct part of a sectionalized body support structure of a floor lamp.

Many types and configurations of floor lamps are presently in use. However, the support structures of these lamps often have features that restrict their use, particularly those floor lamps that are provided with single upright frames or posts. They are often impractical to ship due to their extreme lengths that vary from five to seven feet. The shipping containers presently in use for floor lamps are sized to readily receive and protect all the parts of floor lamps, thus posing a shipping problem due to their large sizes and configurations. Such large sized containers, however, require more shipping room and thus transportation by ship or truck becomes very costly as a high volume of unused space is created. Accordingly, tie shipper is paying for the excess unused space.

OBJECTS AND ADVANTAGES OF THE INVENTION

The present invention comprises a novel arrangement of floor lamp structure, wherein the upright post of the lamp comprises at least two elongated frame sections, each of which is provided with a multiplicity of slots that are defined by outwardly extending spaced-apart rib members that provide a means for removably storing compact discs along the length of the lamppost. The pair of longitudinal frame sections are adapted to be secured together at a central intermediate point between their respective outer ends. Such an arrangement allows the shipping container to be constructed in the standard length of approximately four feet.

Accordingly, it is an important object of the present invention to provide a floor lamp structure that is combined with a storage rack that contains a pair of CD storage rack sections that can be stored in a standard shipping container of approximately four feet in a disassembled mode. The two frame sections are unassembled when shipped and are then assembled after reaching their destination or later when sold to the purchaser. Such a small shipping container thus allows the purchaser of a disassembled floor lamp to take the lamp it at the time of purchase. At present a similar size floor lamp must be delivered by the store in which it is bought.

Another object of the invention is to provide a combination floor lamp and compac-disc storage rack that is formed having an upright post member defined by an elongated housing or body having a plurality of spaced-apart support members, such as ribs, that establish a plurality of storage slots which are arranged to removably receive and store compact discs substantially throughout the length of the body of the lamppost.

Still another object of the present invention is to provide a floor lamp of this character wherein the lamppost is mounted to a base member in a vertical position with a suitable light fixture mounted to the top of the post, and wherein a substantial portion of the post between the light fixture and the base is provided with a plurality of horizontally or angularly arranged equally spaced-apart slots formed within the body or housing wall of the lamppost member defined by the pair of rack sections.

A further object of the invention is to provide a floor lamp of this character wherein the slots are defined by a plurality of spaced-apart transverse rib members formed along the length of the lamp body.

Still a further object of the invention is to provide a first embodiment of a combination floor lamp and compact-disc rack wherein the vertical lamppost is formed having a substantially triangular cross-sectional configuration, whereby each disc support member is defined by a pair of converging integrally formed rib members that extend rearwardly and outwardly of each other, terminating at oppositely disposed elongated side wall members that define rearward upright structural members. The apex of the triangularly arranged rib members defines the pointed front of the lamp structure.

Yet another object of the invention is to provide a second embodiment in combination with a floor lamp and compact-disc rack wherein the vertical lamppost is formed having a substantially circular cross-sectional configuration, whereby a plurality of disc support members are defined by arcuate, integrally formed, rib members that extend forwardly and outwardly from oppositely disposed elongated side wall members that define rearward upright structural members.

Still another object of the invention is to provide a floor lamp structure, as indicated, wherein a lamp fixture is readily mounted to the upper lamp mounting plate with a base member being adapted for mounting to the lower mounting base plate.

It is still a further object of the present invention to provide a floor lamp of this character whereby two sections, the lamp fixture and base member, are easily assembled with the use of only a screwdriver.

A still further object of the present invention is to provide a combination floor lamp of this character that is simple in its structure and rugged in construction, as well as relatively inexpensive to manufacture, and yet pleasing in its design.

The characteristics and advantages of the invention are further sufficiently referred to in connection with the accompanying drawings, which represents at least two embodiments. After considering this example, skilled persons will understand that variations may be made without departing from the principles disclosed; and I contemplate the employment of any structures, arrangements or modes or operation that are properly within the scope of the appended claims.

BRIEF DESCRIPTION OF THE DRAWINGS

With the above and related objects in view, the invention consists in the details, of construction and combination of parts, as will be more fully understood from the following description, when read in conjunction with the accompanying drawings and numbered parts.

DESCRIPTION OF THE PREFERRED EMBODIMENTS

Figure 8:
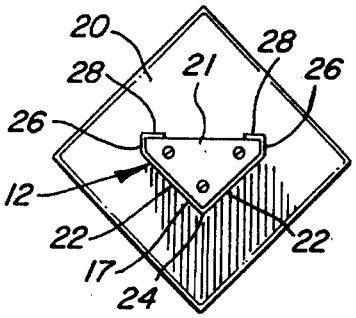
FIG. 8 is a cross-sectional view taken substantially along line 8—8 of FIG. 2.

Referring now in more detail to FIGS. 1 through 7, there is shown in combination a floor lamp, generally indicated at 10, which is structured to contain a pair of compact disc storage racks, designated by numeral 12. Floor lamp 10 comprises an upright lamppost 14 defined as an elongated housing or body member 16 constructed having an upper frame section 15 and a lower frame section 17, each of Which is formed having a vertically arranged compact-disc storage rack 12. Floor lamp 10 includes a suitable light fixture, such as indicated at 18, which is mounted to an upper support plate 30 that defines a means for removably connecting the light fixture at the top of upper section 15, and a housing support; base 20 on which the lower frame section 17 is fixedly secured by any suitable means. The elongated housing 16 is formed by fixedly securing bottom mounting plate 19 of upper frame section 15 to an upper mounting plate 21 of lower frame section 17 by suitable securing means, such as screws or the like, as seen in FIG. 8, so that a triangular cross-sectional configuration is indicated.

Accordingly, two frame sections 15 and 17 of the lamppost housing 16 may be formed by means of an extrusion and/or stamping process. The triangular configuration is defined by a pair of converging side wall members 22, the front of the lamppost being defined by an apex 24 of the triangular portion of the housing. The rear of the triangle is defined by a pair of oppositely disposed flat side-wall members 26 which extend rearwardly of the triangular portion. Each of the flat side-wall members is bent inwardly to define a pair of spaced-apart rear-wall members 28. The upper end of housing 16 is provided with the flat triangular upper support plate 30 on which light fixture 18 is mounted. The lower end of housing 16 is also formed with a flat triangular wall plate 32 which is adapted to be affixed to support base 20, lamppost 14 being secured in an upright position by suitable means, as seen in the cross-sectional view of FIGS. 5 and 8.

Figures 1, 2, 3, 4, 5, 6:
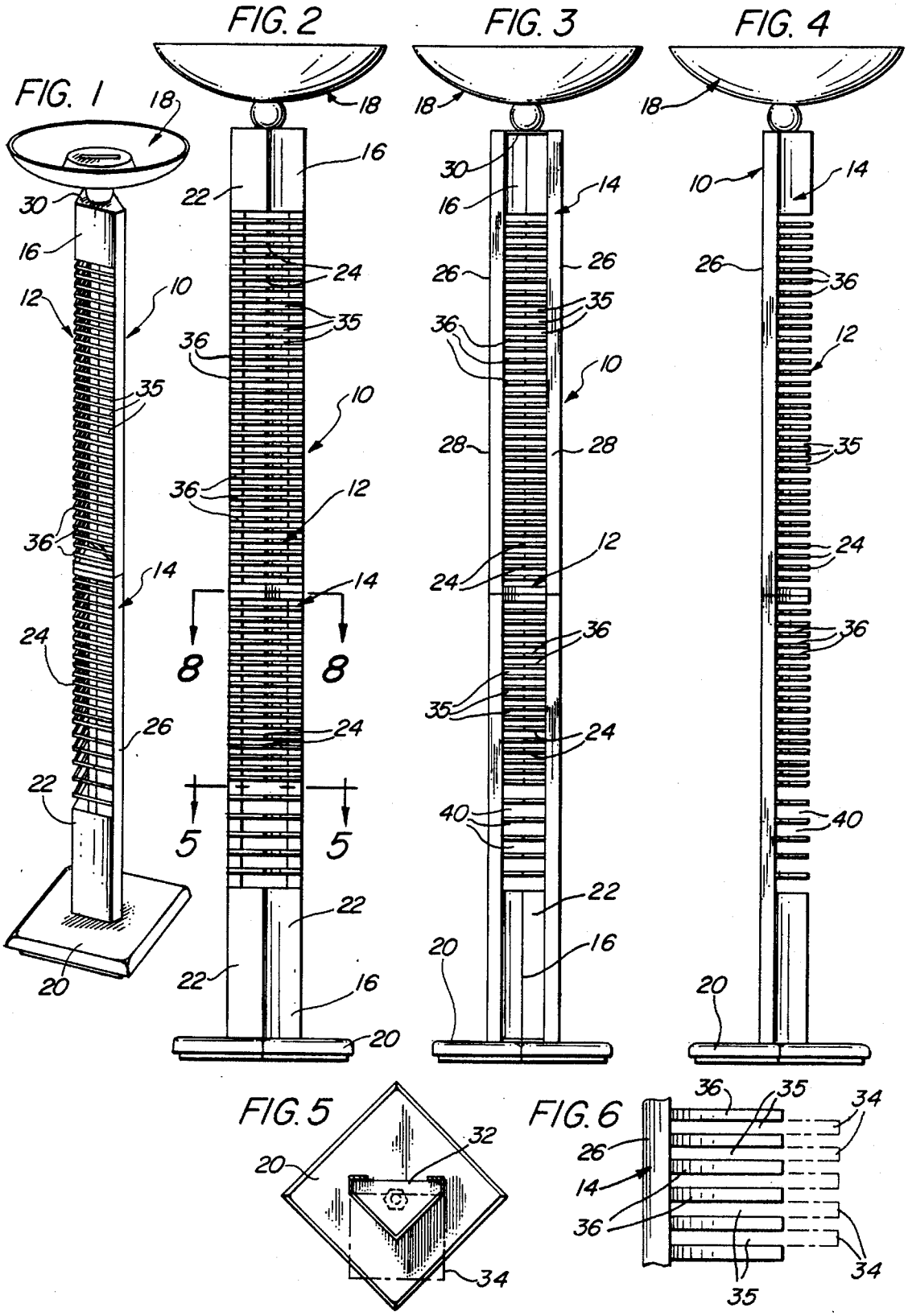
FIG. 1 is a perspective view of the right side of the present invention which is defined as a combination floor lamp and a compact-disc storage rack.
FIG. 2 is a front-elevational view thereof.
FIG. 3 is a rear-elevational view thereof.
FIG. 4 is a left side-elevational view thereof.
FIG. 5 is a cross-sectional view taken along line 5—5 of FIG. 2.
FIG. 6 is a partial enlarged side-elevational view in which compact disc storage boxes are shown in phantom lines and mounted in horizontal storage slots formed in the upright housing of the lamppost.
Figure 7:
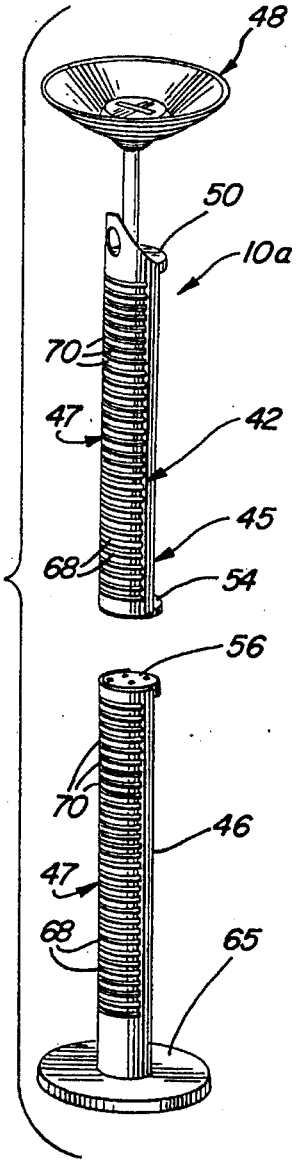
FIG. 7 is an exploded perspective view showing the two frame sections separated.
Figure 13:
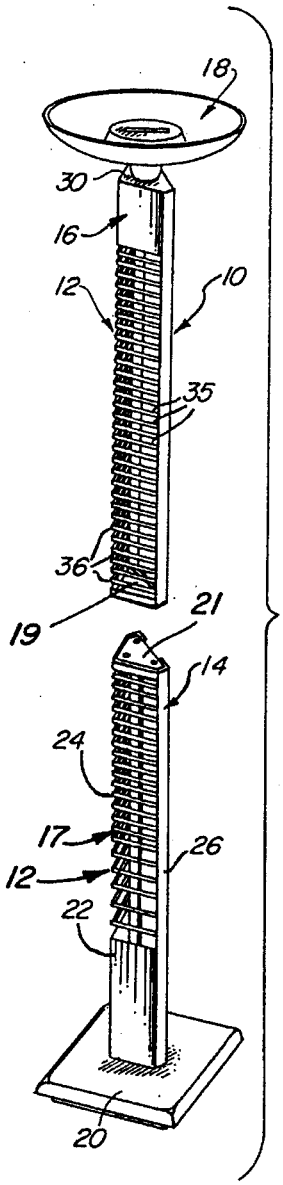
FIG. 13 is an exploded perspective view of the second embodiment showing the upper and lower frame sections separated.
Figure 16:
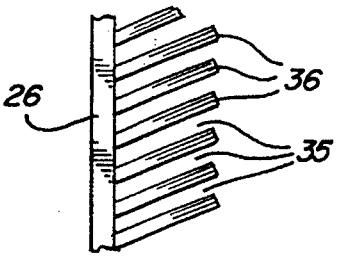
FIG. 16 is a partial enlarged side-elevational view in which storage slots are shown angularly disposed in the upright housing of the lamppost.

A compact disc is commonly stored in a protective case, which is generally a square flat plastic box or case 34, as illustrated by phantom lines in FIGS. 5 and 6. In order to properly store each disc box, storage racks 12 are formed in the respective elongated triangular wall structure of each frame section 15 and 17, and are defined by converging side walls 22. The storage racks are formed by means of a multiplicity of spaced-apart horizontal slots 35 which are defined by corresponding rib members 36. Preferably, rib members 36 are arranged so that each is provided with a slot having a width compatible to the thickness or height of the disc storage box or case 34. However, some rib members may be arranged to define slots that are spaced wider apart so as to receive larger disc boxes, such as enlarged slots 40 shown adjacent the bottom of lamppost housing 14 in FIG. 6. It is also contemplated that slots 35 and rib members 36 will also be formed having an inclined arrangement, as shown in FIG. 16.

Figure 14:
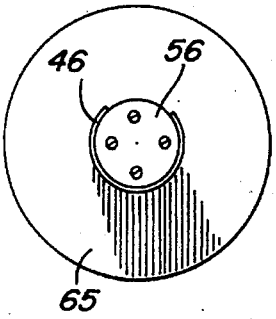
FIG. 14 is a cross-sectional view taken substantially along line 14—14 of FIG. 9.

Referring now to FIGS. 9 through 15, there is illustrated a second embodiment of the present invention, wherein a floor lamp 10*a* is shown having an upright lamppost housing 42 defined as an elongated housing or body member 44 which is defined by an upper frame section 45 and a lower frame section 46, each having vertically arranged compact disc storage racks 47. Floor lamp 10*a* includes a light fixture, generally indicated at 48, mounted to an upper cylindrical support plate 50 at the top of upper frame section 45, and a housing support base 65 on which the lower frame section 46 is fixedly secured by suitable means, such as screws or a nut and bolt. The elongated housing 44 is formed by fixedly securing bottom cylindrical mounting plate 54 of upper frame section 45 to the upper cylindrical mounting plate 56 of the lower frame section 46 by suitable securing means, such as screws, as seen in FIG. 14, whereby a cylindrical cross-sectional configuration of the lamppost is defined.

Figure 15:
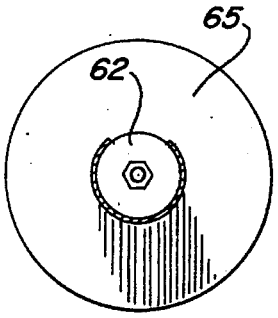
FIG. 15 is a cross-sectional view taken substantially along line 15—15 of FIG. 9.
Figures 9, 10, 11, 12:
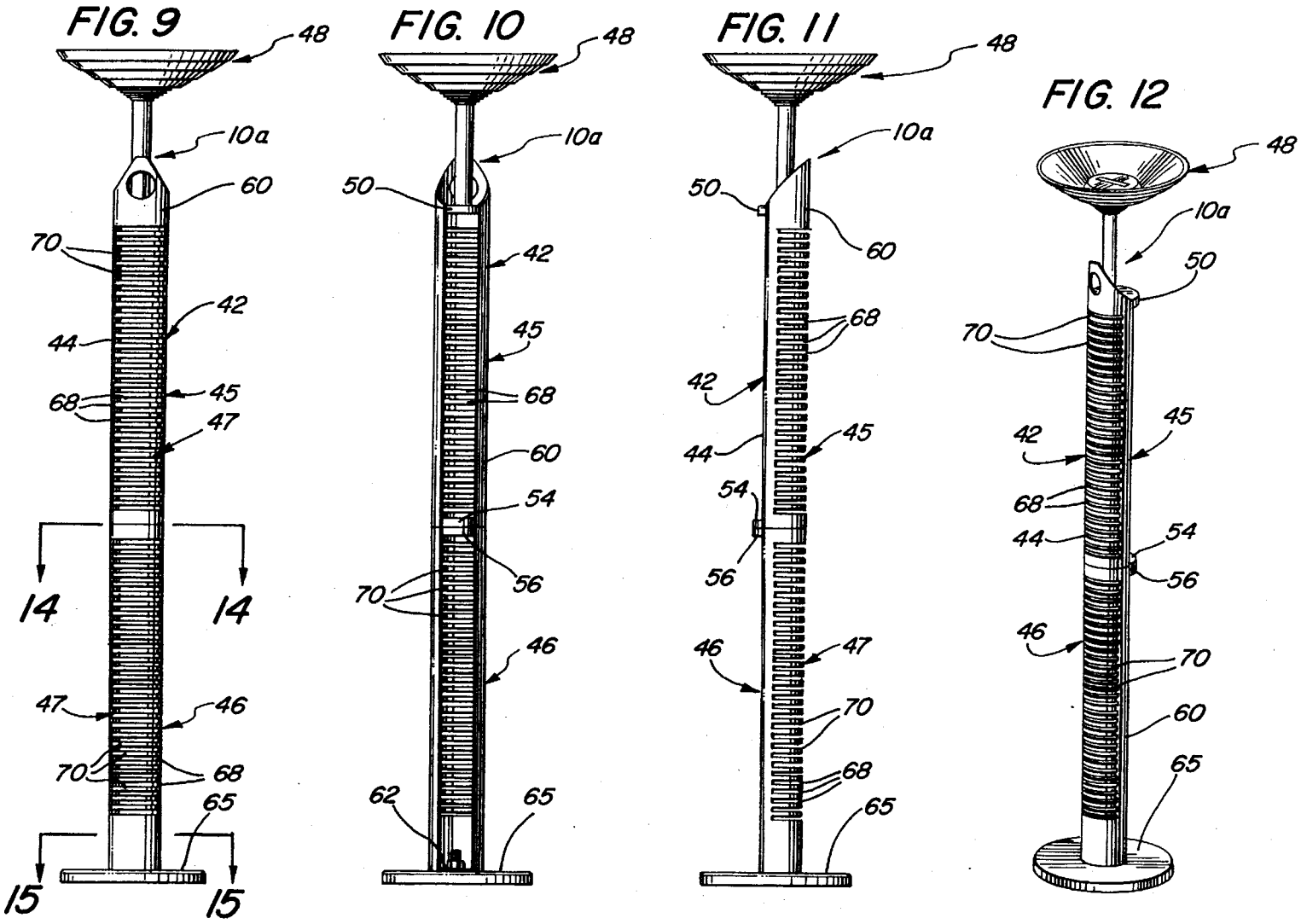
FIG. 9 is a front-elevational view of a second embodiment of the present invention, wherein the lamppost thereof is shown having a substantially circular configuration.
FIG. 10 is a rear-elevational view thereof.
FIG. 11 is a left side-elevational view thereof.
FIG. 12 is a perspective view thereof.

Each frame section 45 and 46 of the lamppost housing 44 may be formed by means of an extrusion and/or stamping process. The cylindrical configuration is defined by a substantially C-shaped wall 60, as indicated in FIGS. 14 and 15, in which the CD storage rack 47 is formed. The lower end of frame section 46 is also formed with a cylindrical plate 62 which is adapted to be secured to support base 65, whereby lamppost 42 is secured in an upright position by suitable means such as a nut and bolt, as illustrated in FIGS. 10 and 15.

Each storage rack 47 is formed by means of a multiplicity of spaced-apart horizontal slots 68 which are defined by corresponding rib members 70. Preferably, rib members 70 are arranged so as to be equally spaced, one above the other, so that each space defines a slot 68 having a width compatible to the thickness or height of the disc storage box or case 34. However, it should be noted that rib members may be angularly disposed relative to the vertical lamppost, whereby slots 68 are rearwardly inclined similar to that seen in FIG. 16.

The characteristics and advantages of the invention are further sufficiently referred to in connection with the accompanying drawings, which represent two embodiments. After considering these examples, skilled persons will understand that variations may be made without departing from the principles disclosed; and we contemplate the employment of any structures, arrangements or modes of operation that are properly within the scope of the appended claims.

What is claimed is:

1. In combination, a floor lamp having storage racks wherein the improvements comprise:

a lamp having a lamppost vertically mounted to a support base, said lamppost being defined by an upper frame section having a top, a bottom and a lower frame section having a top and a bottom, wherein said bottom of said lower frame section is secured to said support base;

a light fixture mounted at said top of said upper frame section secured to said lower frame;

a compact-disc storage means formed in said upper frame section and in said lower frame section, whereby said compact-disc storage means extends along a vertical length of said lamppost, said compact-disc storage means defining storage racks having a multiplicity of spaced slots, each arranged to removably receive and store an individual compact disc therein, said slots being defined by a multiplicity of rib members which are spaced apart from each other; and wherein said lamppost is formed with a front wall defined by a substantially triangular cross-sectional configuration.

2. The combination as recited in claim 1, wherein said storage racks together form an elongated substantially triangular wall structure, said rib members and said slots in said triangular wall structure being formed transversely with respect to the length of said triangular wall structure.

3. The combination as recited in claim 2, wherein said elongated triangular wall structure is defined by converging side walls terminating at a front defined by an apex of said triangular wall structure of said lamppost.

4. The combination as recited in claim 3, wherein said lampost is further defined by a pair of oppositely disposed side-wall members which extend rearwardly of said converging side walls.

5. The combination as recited in claim 1, wherein said storage racks together form an elongated substantially triangular wall structure, said rib members and said slots in said triangular wall structure being formed angularly with respect to the length of said triangular wall structure.

6. A floor lamp structure comprising:

a lamppost defined by a first frame section and a second frame section, wherein said first and second frame sections are removably attached to each other, each frame section being formed by having a compact-disc storage rack therein, said storage rack having a plurality of compact-disc storage means extend along a vertical length of said lamppost;

said first frame section including an upper light fixture connecting end and a lower frame connecting end;

said second frame section including an upper frame connecting end formed to be removably attached to the lower frame connecting end of said first frame section, and a lower base connecting end;

a light fixture removably attached to said upper light fixture connecting end;

a base member removably attached to said lower base connecting end;

means for removably attaching said light fixture to said upper light-fixture connecting end;

means for removably attaching said lower connecting end of said first frame section to said upper frame connecting end of said second frame section;

means for removably attaching said lower base connecting end of said second frame section to said base member;

said storage racks comprising a multiplicity of spaced slots arranged to removably receive and store compact discs therein; and wherein said slots are defined by a multiplicity of rib members which are spaced apart from each other, and said lamppost is formed with a triangular wall structure having a substantially triangular cross-sectional configuration.

7. The floor lamp structure as recited in claim 6, wherein said storage racks together form said, substantially triangular, wall structure, said rib members and said slots being formed transversely in said triangular wall structure with respect to the length of said lamppost.

8. The floor lamp structure as recited in claim 7, wherein said elongated, substantially triangular, wall structure is defined by converging side walls terminating at a front defined by an apex of said triangular wall structure of said lamppost.

9. The floor lamp structure as recited in claim 8, wherein said lamppost is further defined by a pair of oppositely disposed side-wall members which are integrally formed with said converging side walls.

* * * * *